United States Patent [19]

Kobayashi et al.

[11] 4,417,550

[45] Nov. 29, 1983

[54] ENGINE PREHEATING APPARATUS

[75] Inventors: Akihiro Kobayashi, Aichi; Masashi Kida, Okazaki; Novuei Ito, Okazaki; Yoji Kato, Okazaki, all of Japan

[73] Assignee: Nippon Soken, Inc., Nishio, Japan

[21] Appl. No.: 294,821

[22] Filed: Aug. 21, 1981

[30] Foreign Application Priority Data

Aug. 28, 1980 [JP] Japan ..... 55-119556

[51] Int. Cl.[3] ..... F02P 19/02

[52] U.S. Cl. ..... 123/145 A; 123/179 BG; 123/179 H

[58] Field of Search ..... 123/145 A, 179 H, 179 BG, 123/179 B

[56] References Cited

U.S. PATENT DOCUMENTS

| | | | |
|---|---|---|---|
| 4,280,452 | 7/1981 | Kawamura et al. | 123/179 H |
| 4,307,688 | 12/1981 | Steele | 123/179 BG |
| 4,317,434 | 3/1982 | Kato | 123/179 BG |
| 4,363,958 | 12/1982 | Kobayashi et al. | 123/179 H |

*Primary Examiner*—Ira S. Lazarus

*Attorney, Agent, or Firm*—Cushman, Darby & Cushman

[57] ABSTRACT

An engine preheating apparatus in which an actuation circuit for a glow plug mounted in the engine is provided with a starting resistor of barium titanate of which the resistance value abruptly increases at a specific temperature, and a normal-operation resistor connected in parallel to the starting resistor. When the starting resistor is low in temperature and hence has a small resistance value, a large current is supplied to the glow plug, whereas when the starting resistor is high in temperature and therefore has a high resistance, a comparatively small current is supplied to the glow plug through the normal-operation resistor. The starting resistor is comprised of plural resistor elements of barium titanate as a main component and plural electrode plates alternately pressed one on each other. Each of the electrode plates is in pressure contact with each of heat radiators, so that the heat generated by the resistor elements is radiated from the radiators through the electrode plates. The time constant of the resistor elements is determined by the shape of that portion of the electrode plate which is connected to the radiator.

8 Claims, 5 Drawing Figures

ENGINE PREHEATING APPARATUS

RELATED REFERENCES

U.S. Ser. No. 195,504 filed Oct. 9, 1980, now U.S. Pat. No. 4,317,434, in the name of Yoji KATO and U.S. Ser. No. 228,552 filed Jan. 26, 1981, now U.S. Pat. No. 4,363,958, in the name of Akihiro KOBAYASHI et al which were assigned to the same assignee are copending applications of this application.

BACKGROUND OF THE INVENTION

The present invention relates to an engine preheating apparatus aimed at a rapid temperature rise characteristic of a glow plug.

Many conventional Diesel engines are provided with a glow plug for facilitating the engine starting. At the time of engine start, this glow plug is heated to become red-hot and fuel is brought into contact therewith and burnt thereby to facilitate the engine start. The time period required for heating the glow plug to red-hot state (hereinafter referred to as the glow plug preheating time) and the time required for starting the engine by turning the starting motor (hereinafter referred to as the cranking time) are preferably as short as possible. In view of these requirements, the present applicant filed U.S. patent application Ser. No. 195,504, now U.S. Pat. No. 4,317,434, suggesting a method of providing rapid temperature rise characteristic to the glow plug.

Specifically, the apparatus using such a method comprises a glow plug mounted on the engine, an actuation circuit for the glow plug, a starting resistor of barium titanate connected in the middle of the actuator circuit and having a positive temperature coefficient of resistance so that the resistance value thereof suddenly increases at a specific temperature, and a normal-operating resistor connected in parallel to the starting resistor. The resistance value and the heat capacity of the starting resistor are determined in such a manner that when the glow plug circuit is energized, the starting resistor has a resistance value smaller than the normal-operating resistor as long as the glow plug is low in temperature, and the resistance value of the starting resistor exceeds that of the normal-operating resistor at higher temperatures. Further, by decreasing the resistance value of the glow plug and thereby reducing the rated voltage, the rapid temperature rise at low temperatures of the glow plug and the prevention of the breakage of the glow plug by excessive heat at high temperatures of the glow plug are attained at the same time.

When the engine is started and stopped repeatedly, or especially when the engine fails to be started and preheated again several tens of seconds later, however, the temperature rise of the glow plug is likely to be retarded to some degree. This is by reason of the fact that the time constant for cooling the glow plus is smaller than that for cooling the starting resistor. In other words, when the repeated preheating is required several tens of seconds after a starting error, the glow plug is cooled, and in spite of the requirement to restore the starting resistor to normal temperature, it remains at high temperature because of the large time constant thereof. Since the starting resistor remains at high temperature with a high resistance value, current flows through the normally-operating resistor, so that a high voltage fails to be applied to the glow plug, resulting in a slow temperature increase.

SUMMARY OF THE INVENTION

Accordingly, it is an object of the present invention to provide an engine preheating apparatus comprising a glow plug mounted on an engine, a starting resistor of barium titanate connected midway of the actuator circuit for the glow plug and having a positive temperature coefficient of resistance so that the resistance value suddenly increases at a specific temperature or Curie point, a normally-operating resistor connected in parallel to the starting resistor, a heat receiver provided in proximity to the starting resistor for receiving the heat from the starting resistor, and a heat conductor having a predetermined heat conductivity for connecting the heat receiver and the starting resistor to each other, whereby the time for restoration of the starting resistor to normal temperature is shortened, thus maintaining the rapid temperature rise characteristic of the glow plug at the time of the repeated preheating of the engine.

According to the present invention, the starting resistor is comprised of barium titanate as a main component to which such an impurity as manganese, strontium, lead or cerium is added and the resulting compound is fired.

The resistor of barium titanate as a main component has a positive temperature coefficient of resistance as shown in FIG. 2. As seen from this graph, the resistance value which is about 10 MΩ (milliohms) at the normal temperature of 25° C. is suddenly increased to about 10 Ω at about 170° C. This rate of resistor change is about 1000 times the original value. The temperature at which the resistance value abruptly changes (hereinafter referred to as the Curie point) and the rate of resistance change may be controlled by the quantity of the impurity or impurities added to barium titanate. Generally, the Curie point is set to about 100° to 300° C. and the rate of resistance change is set to about 10,000 times.

According to another aspect of the present invention, the normal-operating resistor is comprised of an ordinary metal resistance wire of tungsten, nichrome, copper, iron or SUS etc.

According to still another aspect of the invention, the normal-operating resistor and the starting resistor are so related to each other that the starting resistor has a smaller resistance value than the normal-operating resistor at low temperatures of the glow plug whereas the starting resistor has a greater resistance value than the normal-operating resistor at high temperatures of the glow plug. As a specific example, a sufficient rapid heating effect of the glow plug is attained if the resistance value of the starting resistor is one tenth that of the normal-operating resistor at low temperatures and 10 times or more that of the normal-operating resistor at high temperatures. In such a case, under normal conditions where the glow plug is heated to a high temperature for preheating, the current required for normal operation can be supplied to the glow plug through the normal-operating resistor. Thus the ratio of resistance value between these two resistors is required to be approximately 100.

According to the present invention, the high temperatures of the glow plug are defined as the ones higher than a temperature required for ignition of the fuel in the engine combustion chamber, and the low temperatures of the glow plug are defined as the ones lower than such a temperature. These temperatures, which slighly vary with the type of engine, are about 600° to 700° C. according to the experience of the present inventors.

Since the time constant for the temperature of the glow plug to reach the temperature required for fuel ignition in the combustion chamber is made substantially the same as the time constant for the glow plug temperature to reach the Curie point of the starting resistor, the above-mentioned "low temperatures" designate the ones lower than the Curie point and the "high temperatures" designate the ones higher than the Curie point as viewed from the starting resistor.

The present invention is applicable also to a single-cylinder Diesel engine with equal effect. In the case of a multi-cylinder Diesel engine, a starting resistor may be connected to the glow plug of each cylinder.

DESCRIPTION OF THE PREFERRED EMBODIMENTS

Figure 1:
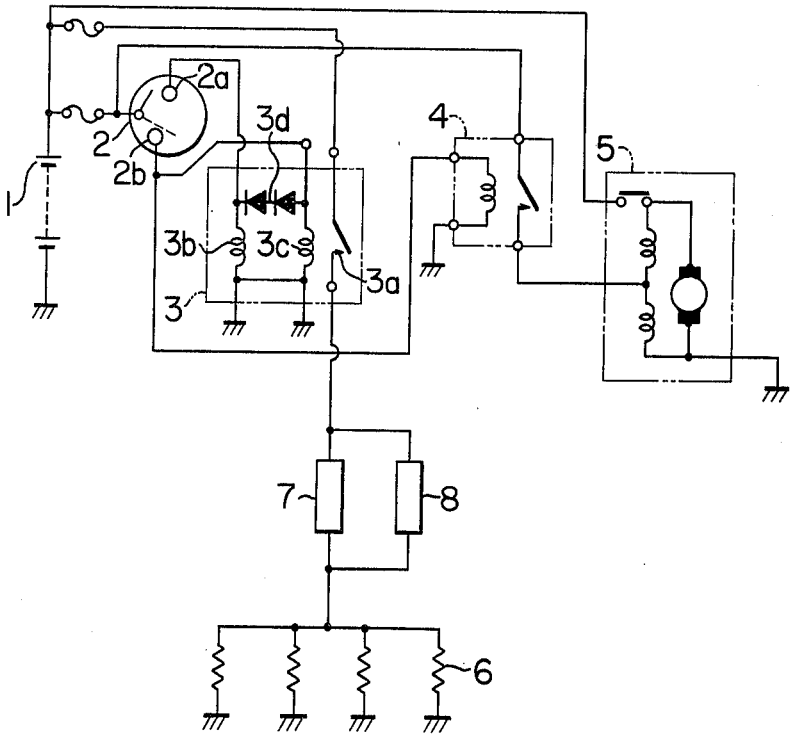
FIG. 1 is an electrical circuit diagram showing an embodiment of the apparatus according to the present invention.
Figure 2:
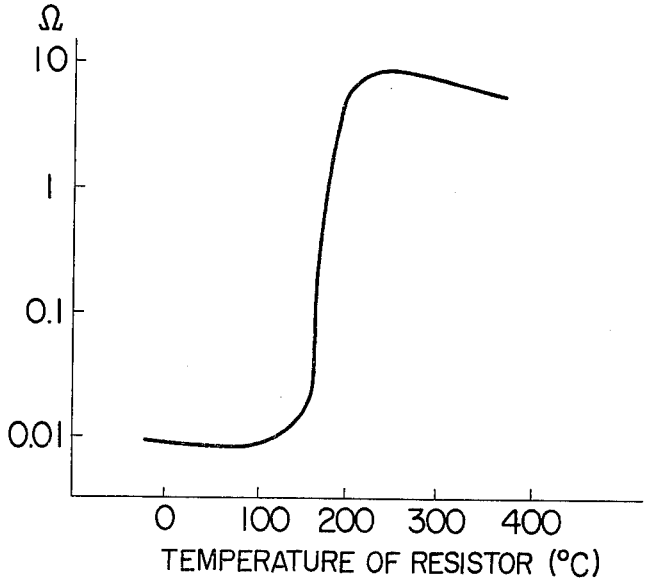
FIG. 2 shows the characteristic of a starting resistor according to the embodiment of FIG. 1.

The present invention will be specifically described below in detail with reference to embodiments. In FIG. 1, reference numeral 1 designates a battery carried on the vehicle, numeral 2 a starter switch and numerals 2*a*, 2*b* preheat contact and starting contact. Numeral 3 designates a glow plug relay, numeral 3*a* a normally-open contact, numerals 3*b* and 3*c* coils, and numeral 3*d* a pair of diodes for preventing reverse current. Numeral 4 designates a starter relay, and numeral 5 a starter. Numeral 6 designates a glow plug constructed in such a well-known manner that a heating coil is contained in a heat-resistant metal tube through electrically insulating powder (not shown in detail). The glow plug 6 is arranged one each in the combustion chamber of each cylinder of the Diesel engine, so that a plurality of glow plugs, say, four glow plugs are connected in parallel. Numeral 7 designates a starting resistor of ceramics with barium titanate as a main component as described above, which has a characteristic as shown in FIG. 2. This starting resistor has a Curie point of about 170° C. and a resistance value of approximately 10 mΩ up to the Curie point, after which the resistance value changes to 10 Ω. The resistor 7 is connected in series to the parallel circuit of the glow plugs 6.

Figure 3:
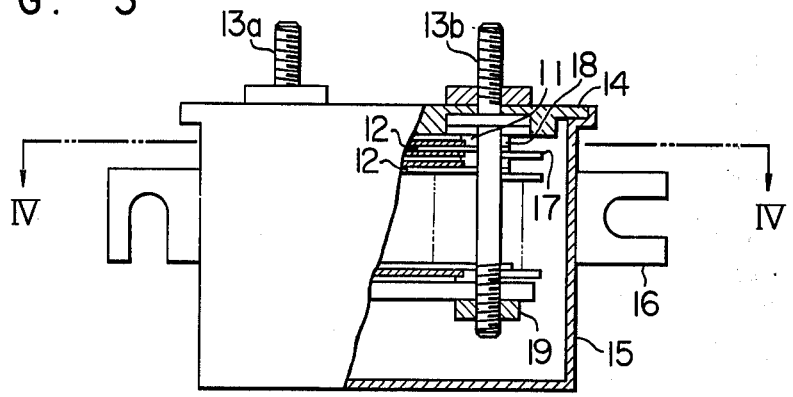
FIG. 3 is a partly-cutaway sectional view showing a detailed construction of the starting resistor according to the embodiment of FIG. 1.
Figure 4:
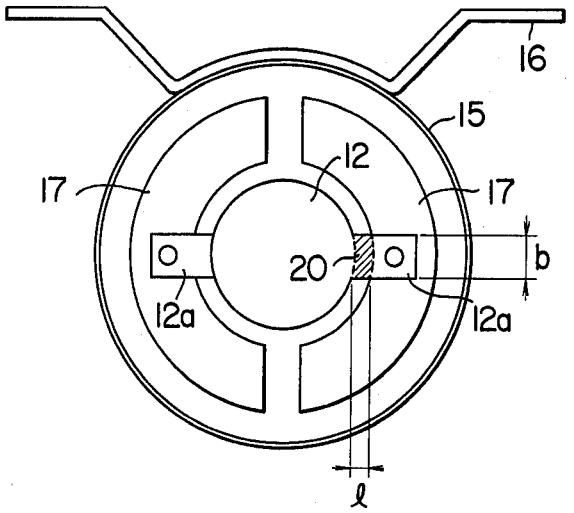
FIG. 4 is a sectional view taken along the line IV—IV in FIG. 3.

A specific construction of the starting resistor 7 will be described with reference to FIGS. 3 and 4. The starting resistor 7 incorporated in a case is shown in FIG. 3. A plurality of electrodes 12 (such as of aluminum) and a plurality of resistor elements 11 of barium titanate are laid one on another alternately. Every other electrode plates 12 are bundled thereby to form a pair of terminals 13*a* and 13*b*. Numeral 14 designates plates for supporting the terminals 13*a* and 13*b* and made of a non-conductive material such as plastics. Numeral 15 designates a metal case for protecting the resistor elements, and numeral 16 a stay adapted to be mounted on or in proximity to the engine body.

Numeral 17 designates a substantially semi-circular heat receiver of aluminum for receiving the heat from the resistor elements 11 of the starting resistor 7. The heat receiver 17 is arranged in close contact with the electrode plates 12 by a metal spacer 18 and a nut 19. The construction of the electrode plate 12 and the heat receiver 17 will be described more in detail. The electrode plate 12 has a rectangular portion 12*a* in contact with the heat receiver 17, so that the electrode plate 12 and the heat receiver 17 are connected by the rectangular portion 12*a*. The heat conduction between the electrode plate 12 and the heat receiver 17 is determined by the width b and the length l of the termal resistor 20 shown by the hatched part of the rectangular portion 12*a* and the thickness t of the rectangular portion 12*a*. Thus although the heat generated in the starting resistor 7 is immediately transmitted to the accumulated electrode plates 12, the amount of heat passed to the heat receiver 17 is limited by the resistor 20 and therefore the characteristic of cooling of the resistor element 11 has a certain time constant. This time constant is made to become the same as the time constant of the glow plug by an experimentally-determined shape of the resistor 20, thus eliminating the inconvenience in which the starting resistor remains at a high temperature while the glow plug is cooled at the time of a repeated preheating resulting in a delayed temperature rise of the glow plug.

If the heat receiver 17 is lacking, the starting resistor 7 is cooled exclusively by heat transmission to air which is very low in speed.

The operation of the apparatus having the above-mentioned construction will be described. Upon closing the switch 2 on the preheating contact 2*a*, the current flows from the battery 1 to the coil 3*b* of the glow plug relay 3, so that an attractive force is generated in the coil 3*b* thereby to close the point 3*a*. Since the preheating is required at this time, the temperature of the glow plug 6 is naturally low and therefore the resistance value of the starting resistor 7 is 10 mΩ which is much lower than the resistance value 0.10 Ω of the normal-operation resistor 8. As a result, the current from the battery 1 flows through the contact 3*a* of the glow plug relay 3 and the starting resistor 7 to the glow plug 6 thereby to heat the glow plug 6. Immediately after the starting of current flow, the resistor 7 is not heated and has a very low resistance value, therefore, a large current flows in the glow plug 6. With the lapse of the turn-on time, the resistor 7 is heated. In view of the fact that is seen from the characteristic diagram of FIG. 2, the resistance value of the starting resistor 7 remains substantially unchanged until the temperature reaches the Curie point of 170° C., however, the large current continues to flow in the glow plug 6. In this way, the rise time of temperature due to conduction of the glow plug is remarkably shortened. A sustained flow of a large current in the glow plug 6 would break the heating coil. With the lapse of time, however, the resistor 7 is heated and reaches the Curie point of FIG. 2, so that the resistance value of the resistor 7 sharply increases and the current flowing in the glow plug 6 is reduced greatly, thus preventing the heating coil of the glow plug 6 from being broken.

With the sharp increase in the resistance value (up to 10 Ω) of the starting resistor 7, the resistance value (0.10 Ω) of the normal-operation resistor 8 connected in parallel therewith becomes smaller than that of the starting resistor 7, and therefore, power is supplied to the glow plug 6 through the resistor 8, thus maintaining the temperature of the glow plug 6 at a level required for steady run of the engine.

Immediately after the repeated preheating following a starting error of the engine, both the glow plug and the starting resistor 7 are considered to be at high temperature. Then the glow plug is cooled at a predetermined time constant. The starting resistor 7 is also cooled by the heat receiver 17 at a time constant which is substantially the same as the time constant of cooling the glow plug 6. Thus with the cooling of the glow plug 6, the starting resistor 7 is also cooled at substantially the same rate.

In the case where the engine is preheated again immediately after the glow plug is reduced to low temperature several tens of seconds after a starting error of the engine, the starting resistor 7 is at low temperature and the resistance value thereof is as low as 10 mΩ, so that a large current is supplied through the starting resistor 7 to the glow plug, thus increasing the temperature of the glow plug rapidly.

Figure 5:
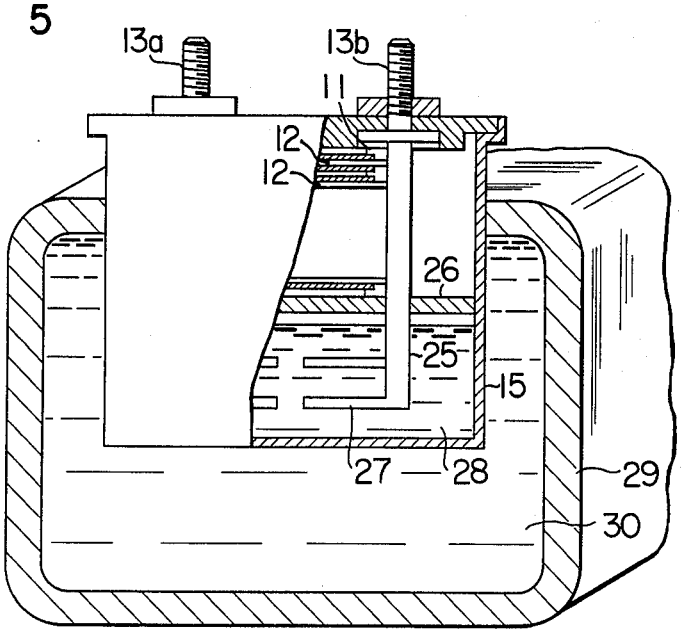
FIG. 5 is a partly-cutaway sectional view showing a detailed construction of the starting resistor according to another embodiment of the invention.

Another embodiment of the starting resistor 7 is shown in FIG. 5. This drawing illustrates the starting resistor 7 incorporated in a case. Resistor elements 11 and electrode plates 12 are alternately laid as in the embodiment of FIG. 3, and alternate electrode plates 12 form a pair of terminals 13*a* and 13*b*. The terminals 13*a* and 13*b* are connected to the heat conductor 25 respectively, an end of which is extended into an oil chamber in a metal case 15 through a diaphragm 26 in the metal case 15 as shown. The end of the heat conductor 25 makes up a radiator 27 in contact with the oil 28. The part of the metal case 15 including the exterior of the oil chamber is immersed in the engine cooling water in the cooling water pipe 29, so that the oil temperature is approximately the same as the temperature of the cooling water which in turn is near the engine temperature. In this way, the embodiment under consideration uses an oil which is a liquid as the heat receiver, the temperature of which is maintained almost the same as that of the cooling water which in turn is substantially equal to the engine temperature. The metal case 15 containing the starting resistor 7 may be placed in an environment where the engine oil temperature is capable of being detected instead of placing it in the cooling water.

The heat receiver according to the present invention may take any form of construction in which the temperature of the receiver itself does not increase to a considerable degree even when absorbing the heat from the starting resistor. For example, a heat receiver having a large heat capacity may be used to absorb the heat although not shown. In this case, the heat receiver preferably has a heat capacity at least not smaller than that of the starting resistor.

We claim:

1. An engine preheaating apparatus comprising a glow plug mounted on the engine, an actuation circuit for flowing current through said glow plug, a starting resistor of barium titanate as a main component connected to said actuation circuit, said starting resistor having a positive temperature coefficient of resistance and a Curie point of a specific temperature where the resistance value thereof sharply increases, a normal-operation resistor connected in parallel to said starting resistor, a heat receiver placed in proximity to said starting resistor for receiving the heat from said starting resistor, and a heat conductor having a predetermined thermal conductivity for connecting said heat receiver and said starting receiver to each other.

2. An engine preheating apparatus according to claim 1, wherein said heat receiver includes a plurality of heat radiators.

3. An engine preheating apparatus according to claim 1 or 2, wherein the heat capacity of said heat receiver is larger than that of said starting resistor.

4. An engine preheating apparatus according to claim 1, wherein said starting resistor includes a plurality of resistor elements of barium titanate and a plurality of electrode plates laid one on another alternately, said electrode plates being alternately bundled thereby to form a pair of electrodes contained in a metal case.

5. An engine preheating apparatus according to claim 4, wherein said heat receiver includes a plurality of radiators each in pressed contact with each of said electrode plates, each of said resistor elements generating heat which is transmitted to said laminated electrode plates and radiated through said radiator plates in pressed contact therewith.

6. An engine preheating apparatus according to claim 5, wherein the time constant for cooling said resistor elements is determined by the shape of that portion of said electrode plate which is connected to said radiator.

7. An engine preheating apparatus according to claim 1, wherein said starting resistor includes a plurality of resistor elements of barium titanate and a plurality of electrode plates laid one on another alternately, alternate ones of said electrode plates being bundled thereby to form a pair of electrodes contained in a metal case, said pair of electrodes being connected to heat conductors respectively extending into a chamber filled with an oil in said metal case, the end of said heat conductor in contact with said oil forming a heat radiator, so that said heat receiver is made up of said oil, and at least the part of said metal case corresponding to said oil chamber is immersed in the engine cooling water.

8. An engine preheating apparatus according to claim 6, wherein said metal case is placed in an environment for detecting the temperature of the engine oil.

* * * * *